United States Patent [19]

Cronin

[11] 4,025,977

[45] May 31, 1977

[54] ANGULAR FOOT FIN

[75] Inventor: John J. Cronin, El Toro, Calif.

[73] Assignee: U. S. Divers Co., Santa Ana, Calif.

[22] Filed: Sept. 12, 1975

[21] Appl. No.: 612,677

[52] U.S. Cl. ..... 9/309
[51] Int. Cl.[2] ..... A63B 31/10
[58] Field of Search ..... 9/301–304, 9/309; 36/2.5 AA, 11.5

[56] References Cited

UNITED STATES PATENTS

| | | | |
|---|---|---|---|
| 2,729,832 | 1/1956 | Schmitz | 9/309 |
| 3,082,442 | 3/1963 | Cousteau et al. | 9/309 |
| 3,171,142 | 3/1965 | Auzols | 9/309 |
| 3,268,927 | 8/1966 | Markowitz | 9/309 |

FOREIGN PATENTS OR APPLICATIONS

| | | | |
|---|---|---|---|
| 969,680 | 7/1958 | Germany | 9/309 |
| 557,786 | 2/1957 | Italy | 9/309 |

*Primary Examiner*—Trygve M. Blix
*Assistant Examiner*—Jesus D. Sotelo
*Attorney, Agent, or Firm*—George Frazier Bethel; Patience K. Bethel

[57] ABSTRACT

The following specification discloses a foot fin for propelling one through the water, having a blade surface that can be oriented within the same axis as the leg of a user. The foot fin enables one to propel oneself through the water and maintain a similar axial orientation of the driving portion of the fin, to the user's leg. In order to provide for walking while the fin is not being used in the water, a hinge point is inserted within the fin to allow it to be placed within the same general plane as the sole of a user's foot.

3 Claims, 5 Drawing Figures

ANGULAR FOOT FIN

BACKGROUND OF THE INVENTION

1. Field of the Invention

The field of this invention lies within the swimming fin art, particularly as it relates to one swimming through the water by means of a foot fin.

THE PRIOR ART

The prior art related to swim fins incorporates various modes and modifications thereof. Such fins generally have a foot receiving portion into which a foot is fitted, such as a pocket or a combination of straps and a pocket. The foot portion can be provided with an open toe or a closed toe, depending upon the preference of a user.

Recently, fins have been adapted with various openings to allow for the movement of water therethrough. In addition thereto, various modifications of fins with regard to vanes and ribs have been incorporated in the prior art. However, the prior art has not optimized the angular relationship of foot fins with regard to the normal driving forces provided by a swimmer.

As can be appreciated, swim fins that extend outwardly in a substantially planar relationship to a user's sole of his foot do not allow for the axial relationship of the leg to be oriented in the same direction as that of the foot fin. The driving or propelling force provided by the leg and the foot fin are in somewhat countervailing force relationships to each other. This causes drag, as well as an inability to optimize power during the propelling or drive stroke of the leg and foot.

Many swimmers have tried to optimize the relationship of the fin angle being placed in axial relationship to the leg by extending the ankle and toes backwardly in a pointed direction. This serves to exaggerate the effort that is required in swimming, particularly with respect to the muscles of the lower leg. As a consequence, the muscles of the lower leg become tired and do not enhance the overall ability of the swimmer to use his legs as effectively as he might.

In addition to the foregoing, cramps are oftentimes encountered by a swimmer due to the fact that his toes are extended backwardly in order to provide an optimal angular relationship of the foot fin with respect to the leg. These cramps are oftentimes debilitating and cause substantial discomfort and possible hazards to a swimmer or diver.

As a consequence of the foregoing, certain efforts have been made in order to provide a parallel planar relationship with respect to a swimming fin and the main driving force of one's lower leg, to provide optimum efficiency of the fin. However, such efforts have caused the fin to be oriented in a downwardly fixed relationship. This creates certain problems with regard to walking.

This invention is such that it overcomes the deficiencies of the prior art by providing a fin having a propelling surface at an optimum angle with respect to a user's leg. The optimum fin angle can be oriented after a user is in the water, by angularly orienting the blade surface downwardly to provide a planar relationship between the fin and the leg in a substantially axial conformation. The placement of the fin at the downward angle to conform to the axial relationship of the leg is provided by merely bending the fin downwardly after the diver has dived into the water, or has eliminated the necessity of walking with the fin.

As a consequence, this invention allows one to use the swim fin at an optimum angle of drive with regard to one's legs and additionally walk with the fin.

SUMMARY OF THE INVENTION

In summation, this invention comprises a water propelling swim fin having an angular relationship to enhance the driving force thereof.

More particularly, the invention involves a fin having an angular blade orientation that can be changed with respect to a user's foot. The angular relationship allows for walking on the blade in a normally planar relationship with the sole of a user's foot. When the blade is canted downwardly, it permits the user to swim with the fin in an optimum manner, for enhancing the propelling drive force thereof.

As a consequence, this invention is to be construed broadly, as will be seen in the following specification, to allow one to walk on a foot fin having an angular blade.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figures 1, 2, 3, 4, 5:
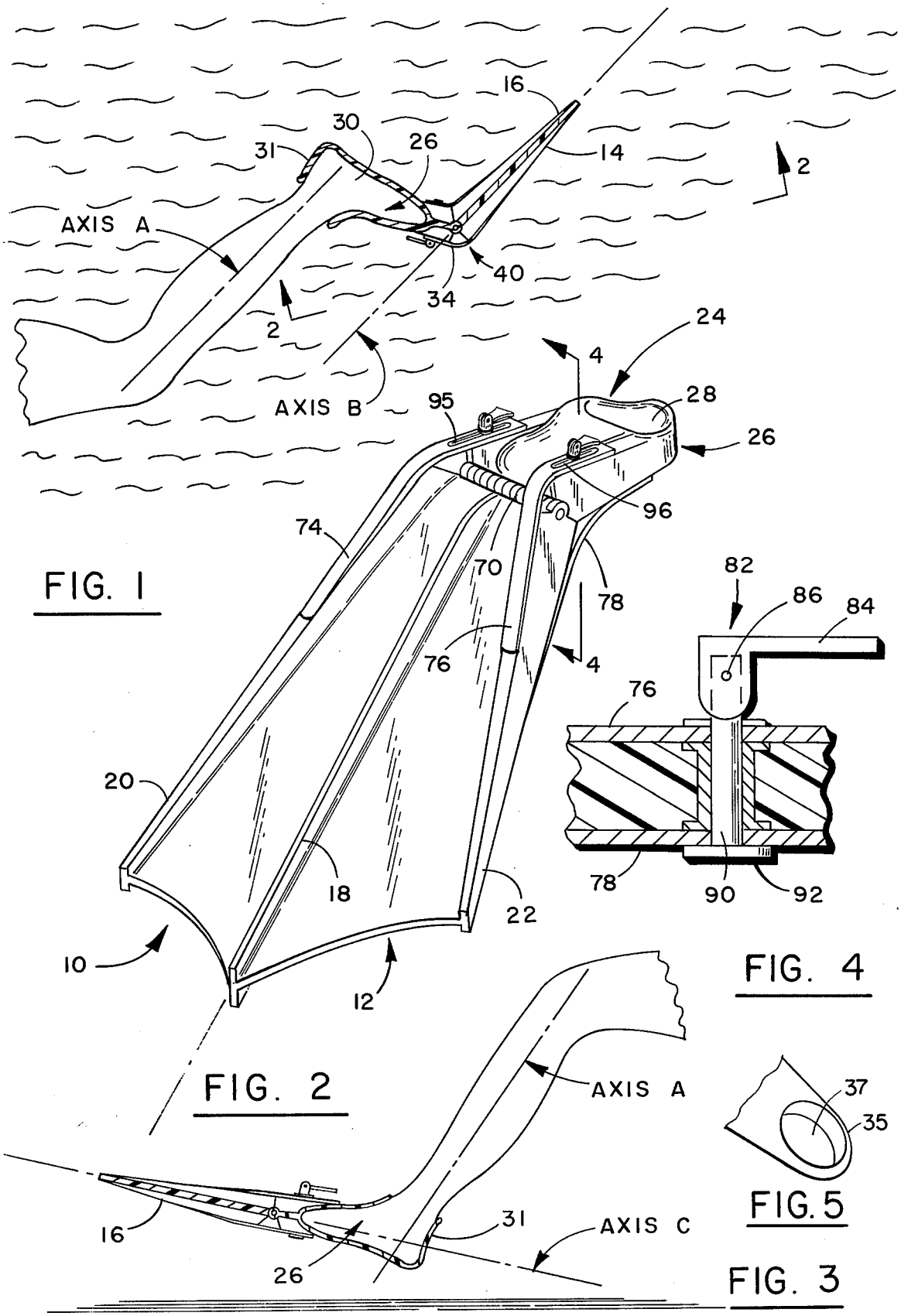
FIG. 1 shows a mid-line sectional view of the swimming fin of this invention on a user's foot.
FIG. 2 shows a perspective view of the swimming fin of this invention in the general direction of lines 2—2 of FIG. 1.
FIG. 3 shows a view of this invention with the fin in its extended relationship when it has been folded upwardly to enable one to walk when not swimming.
FIG. 4 shows a sectional view of the operative locking element of this invention; and, FIG. 5 shows a plan view of a strap that can be used instead of the foot pocket which has been substituted for the general configuration of the foot pocket as shown in the previous figures.

Looking more particularly at FIG. 2, it can be seen that a swimming fin 10 is shown having a main blade or propelling surface 12. The main blade portion 12 comprises upper and lower surfaces 14 and 16. The surfaces are divided by a central rib 18 and two peripheral edge ribs 20 and 22. The ribs 18, 20 and 22 serve to reinforce the propelling or blade surface 12 so that it will not unduly flex, yet provide the propulsion inherent within this invention.

The blade portion 12 extends laterally and outwardly from the foot portion toward the end of the blade. It describes an angle expanding from the foot portion when looking down or up at the blade.

A foot receiving portion 24 is shown with a foot cavity or pocket 26. The foot cavity 26 has an opening 28 into which a person's foot is implaced. As can be seen, a foot 30 has been implaced within the cavity and is secured by a heel 31 so as to allow for the user to propel himself through the water with the fin 10.

The foot pocket or cavity can be abreviated by eliminating the heel 31 of the foot portion 24 and providing straps having buckles to secure the foot 30 within the foot portion.

FIG. 5 shows the alternative utilizing the strap embodiment wherein a strap 35 is shown making an opening 37 that is normally the user's heel in the foot pocket embodiment.

The leg of the user is oriented in an axis A which is generally through a central plane passing through the lower portion of the leg. When the fin is in use, axis B defines the position of the blade 12 which is substantially in parallel relationship with axis A.

Thus, in operation, an optimization of the driving force by the user shown in FIG. 1 is provided in a substantially parallel axial mode so that the blade within axis B is working in the same frame of reference as the axis of the leg, namely axis A. This serves to allow the force of one's leg to drive the blade portion of the fin 10 through the water in the same general direction as the leg of the user. This tends to optimize the drive force and prevents drag by the fin against the water during the recovery strokes.

An added feature of this invention is the foldable or retractable blade element thereof. In particular, a bending line 34 through which the blade can be bent is shown. The bending line 34 provides an area through which the blade 12 can be bent upwardly or downwardly into the respective axes B or C that comprise the showings in FIGS. 1 and 3.

In order to hold the blade 12 in the axially downward position, a member 40 in implaced within the rubberized portion of the blade 12, such as a metal overcenter lock, a cam lock, or a stiffener such as a malleable metallic element or plastic to allow the blade to assume the position into which it is bent.

The overcenter lock or cam lock allows the blade 12 to be placed into a position such as that of axis B for swimming purposes. After the swimming has decided to walk he can then bend the blade 12 upwardly into the general axis shown as axis C. This facilitates walking by the swimmer in the manner in which he is accustomed to, such as when a normal fin of the prior art is used.

In the embodiment as shown, a hinge point, exemplified by any suitable hinge 70, has been shown with upper and lower braces, respectively 74, 76 and 78. The braces can be molded into the rubber and can comprise any suitable stiffening material to retain the fin in its two respective axes.

A cam lock 82, which has a handle 84 and a pivot pin 86 is used to secure the fin in its proper location. This is accomplished by moving the fin when the lock 82 is in the relaxed position (i.e., with the handle 84 up). The upper braces 74 and 76 can then slide over a clamping pin which is secured by an end cap 92. This is accomplished by the braces 74 and 76 having slots 95 and 96 respectively to accommodate such movement and attendant locking when the handle 84 is in the down position, as shown.

As can be seen from the foregoing invention, this patent application teaches the broad aspects of a swimming fin having an axial orientation with respect to the axis of one's leg, while being capable of placement in a formation enabling one to walk on a flat surface. Thus, this invention is to be read broadly in light of the following claims for covering the scope and spirit of the foregoing specification.

I claim:

1. A swimming fin comprising:

A foot receiving portion having a blade extending therefrom in a manner whereby the blade can be oriented into a semi-rigid extended position at an attitude of being substantially in the same axis as the general axial direction of a user's leg during swimming movements to the extent of the inherent resiliency of the material forming the fin and wherein said blade extends laterally outwardly in a direction away from the foot receiving portion; and, means for orienting said blade from an axis substantially in parallel relationship to a user's leg into an axis substantially parallel to a user's sole of the foot to enable a user to walk with the fin when the user is not using the fin in a swimming mode.

2. The swimming fin as claimed in claim 1 wherein:

said means for orienting said blade comprises a stiffening member within the fin that can be disoriented into the two respective axes.

3. The swimming fin as claimed in claim 1 wherein:

said means for holding said fin in a specific axis comprises a mechanical lock connected across the bending line of said fin.

* * * * *